US005635055A

United States Patent [19]

Sweet et al.

[11] Patent Number: 5,635,055

[45] Date of Patent: Jun. 3, 1997

[54] MEMBRANE PROCESS FOR INCREASING CONVERSION OF CATALYTIC CRACKING OR THERMAL CRACKING UNITS (LAW011)

[75] Inventors: James R. Sweet, Unionville, Canada; Tan-Jen Chen, Kingwood, Tex.; Charles P. Darnell, Baton Rouge, La.

[73] Assignee: Exxon Research & Engineering Company, Florham Park, N.J.

[21] Appl. No.: 277,451

[22] Filed: Jul. 19, 1994

[51] Int. Cl.[6] ..... C10G 25/00

[52] U.S. Cl. ..... 208/99; 208/108; 208/310 R; 208/254 R

[58] Field of Search ..... 208/99, 108, 310 R, 208/254 R

[56] References Cited

U.S. PATENT DOCUMENTS

| | | | |
|---|---|---|---|
| 2,930,754 | 3/1960 | Stuckey | 210/23 |
| 2,958,656 | 11/1960 | Stuckey | 210/23 |
| 3,164,542 | 1/1965 | Mitchell | 208/78 |
| 3,193,489 | 7/1965 | Gemmell | 208/80 |
| 3,281,351 | 10/1966 | Gilliland et al. | 208/67 |
| 3,303,123 | 2/1967 | Payton et al. | 208/76 |
| 3,370,102 | 2/1968 | Carpenter et al. | 260/674 |
| 3,598,721 | 8/1971 | Haensel | 208/89 |
| 3,714,022 | 1/1973 | Stine | 208/62 |
| 3,758,401 | 9/1973 | Bridgeford | 208/78 |
| 3,763,034 | 10/1973 | Kett | 208/53 |
| 3,799,869 | 3/1974 | Deed et al. | 208/211 |
| 3,806,445 | 4/1974 | Henry et al. | 208/87 |
| 4,115,465 | 9/1978 | Elfert et al. | 260/674 |
| 4,367,135 | 1/1983 | Posey | 208/108 |
| 4,447,315 | 5/1984 | Lamb et al. | 208/99 |
| 4,454,023 | 6/1984 | Lutz | 208/96 |
| 4,497,705 | 2/1985 | Weinberg et al. | 208/127 |
| 4,528,088 | 7/1985 | Chang et al. | 208/96 |
| 4,534,854 | 8/1985 | Weinberg et al. | 208/131 |
| 4,542,114 | 9/1985 | Hegarty | 208/106 |
| 4,618,412 | 10/1986 | Hudson et al. | 208/59 |
| 4,640,762 | 2/1987 | Woods et al. | 208/56 |
| 4,655,903 | 4/1987 | Rahbe et al. | 208/96 |
| 4,914,064 | 4/1990 | Schucker | 502/4 |
| 4,929,358 | 5/1990 | Koenitzer | 210/640 |
| 4,931,165 | 6/1990 | Kalnes | 208/100 |
| 4,944,880 | 7/1990 | Ho et al. | 210/640 |
| 4,946,594 | 8/1990 | Thaler et al. | 210/651 |
| 4,954,242 | 9/1990 | Gruia | 208/99 |
| 4,962,271 | 10/1990 | Black et al. | 585/819 |
| 4,975,178 | 12/1990 | Clem et al. | 208/65 |
| 4,990,275 | 2/1991 | Ho et al. | 252/62.3 Q |
| 5,124,023 | 6/1992 | Bosserman et al. | 208/99 |

FOREIGN PATENT DOCUMENTS

| | | | |
|---|---|---|---|
| 2600669 | 12/1987 | France | C10G 65/12 |

OTHER PUBLICATIONS

*Modern Petroleum Tech.*, ed E. Hobson pp. 199–201 1973.

*Primary Examiner*—Helane Myers

*Attorney, Agent, or Firm*—Joseph J. Allocca; James H. Takemoto

[57] ABSTRACT

The yield and quality of products secured from cracking units is increased by the process of subjecting the product stream secured from such cracking unit to a selective aromatics removal process and recycling the recovered aromatics lean (saturates rich) stream to the cracking unit whereby such saturates rich stream is subjected to increased conversion to higher value desired products.

6 Claims, No Drawings

MEMBRANE PROCESS FOR INCREASING CONVERSION OF CATALYTIC CRACKING OR THERMAL CRACKING UNITS (LAW011)

FIELD OF THE INVENTION

The present invention relates to the production of motor gasoline and $C_3$–$C_5$ olefins in increased yield from cracking operations.

Non-hydrogen consuming conversion processes such as catalytic and thermal cracking and coking treat paraffinic and naphthenic molecules by cracking them to lower molecular weight/higher value products. The distillate boiling range products (such as cycle oils) are still of relatively low value because of high concentrations of low hydrogen content aromatic molecules. Because of their aromatic content such distillate product boiling range streams cannot be converted by cracking alone (cat cracking or thermal cracking) and are therefore either blended off with other streams or sent to hydroprocessing. The saturated molecules in the streams are therefore down-graded to lower value products rather than recovered and cracked to valuable motor gas or olefin products.

BACKGROUND OF THE INVENTION

U.S. Pat. No. 3,193,480 describes a process whereby a hydrocarbon stream having a high metal content is subjected to mild cat cracking in a first cracking zone and a hydrocarbon stream of low metal content is subjected to severe cat cracking in a second cracking zone, cracked products are recovered from both cracking zones and the cycle oil fractions produced are subjected to solvent extraction resulting in the production of an aromatics rich extract and a non-aromatics rich raffinate, this raffinate then being recycled to the severe cracking zone. The aromatic hydrocarbons are recovered from the extract and recycled to the mild cat cracking zone. See also U.S. Pat. Nos. 3,164,542 and 3,303,123.

U.S. Pat. No. 3,281,351 teaches a process wherein a hydrocarbon stream is cracked and the effluent is fractionated. The gasoline and fuel oil fractions are hydrotreated and then solvent extracted to produce an aromatics extract and a paraffinic/olefinic raffinate which is recycled to the cracking zone.

U.S. Pat. No. 3,714,022 teaches a process wherein a naphtha is subjected to low severity reforming and the reformate is subjected to an aromatics removal process whereby a saturates rich fraction is subsequently recovered, the saturates rich fraction being then sent to a cracking zone to give light hydrocarbons and a heavy cracked material. The heavy cracked material is sent to the aromatics separation zone resulting in an increased in the amount of saturates recovered in said zone and consequently recycled to the cracking zone.

U.S. Pat. No. 3,758,410 teaches a process wherein a low octane light straight run gasoline is cracked in a first cracking zone and a cracked product is recovered, a gas oil is cracked in a second cracking zone and light cracked gasoline and heavy cracked gasoline fractions are recovered; the heavy cracked gasoline is subjected to reforming to produce a reformate which is solvent extracted to produce an aromatics rich extract and a saturates rich raffinate. This raffinate stream is recycled to the first cracking zone. The cracked product from the first cracking zone is combined with the light cracked gasoline from the second cracking zone to produce a combined gasoline product. A $C_2$ and $C_3$ olefin stream is also recovered from the first cracking zone while a $C_3$ and $C_4$ olefin stream is recovered from the second cracking zone. See also U.S. Pat. No. 3,763,034.

THE PRESENT INVENTION

Liquid hydrocarbonaceous feeds boiling in the range of about 65° to 1050° F. and higher (~18.3° to 565.5° C. and higher) such as naphtha, which boils in the range of about 65° to 430° F. (~18.3° to 221° C.), distillates which boil in the range of about 300° to 800° F. (~149° to 426.7° C.), hydrocarbonaceous oils boiling in the range of about 430° F. to about 1050° F., (221° to about 565.5° C.) such as gas oil; heavy hydrocarbonaceous oils comprising materials boiling above 1050° F.; (565.5° C.) heavy and reduced petroleum crude oil; petroleum atmospheric distillation bottoms; petroleum vacuum distillation bottoms; pitch, asphalt, bitumen, other heavy hydrocarbon residues; tar sand oils, shale oil; liquid products derived from coal liquefaction processes, and mixtures thereof, are sent to non-hydrogen consuming catalytic or thermal cracking or coking process zones whereby a liquid cracking or coking effluent boiling in the 65° to 800° F. (18.3° to 426.7° C.) range is produced. The effluent as such or a fraction of it, preferably a naphtha boiling fraction (65° to 430° F.) or a distillate boiling fraction (300° to 800° F.) is conveyed to a membrane aromatics separation zone wherein aromatics rich fractions and non-aromatics rich fractions are produced. The non-aromatics rich fraction is recycled to the cracking or coking process zone wherein the non-aromatics rich fraction is combined with fresh feed and is converted to lighter, more valuable gasoline and light olefinic products. The aromatics rich fraction can be sent to blending or subsequent hydroprocessing. The volume of material sent to blending or subsequent hydroprocessing is reduced by the intervening aromatics/non-aromatics separation process practiced on the naphtha and/or distillate product coming from the cracker or coker.

The non-hydrogen consuming catalytic or thermal cracking or coking zone is operated under conditions which are standard and typical for such processes.

Thus catalytic cracking employs a catalyst which comprises a matrix material constituted of from about 10 percent to about 50 percent, preferably from about 15 percent to about 30 percent, based on the total weight of the catalyst composition, within which is dispersed a crystalline aluminosilicate zeolite, or molecular sieve, natural or synthetic, typically one having a silica-to-alumina mole ratio (Si/Al) of about 2, and greater, and uniform pores with diameters ranging from about 4 Angstroms to about 15 Angstroms. The zeolite component content of the catalyst ranges from about 15 percent to about 80 percent, preferably from about 30 percent to about 60 percent, and more preferably from about 35 percent to about 55 percent, based on the total weight of the catalyst.

In catalytic cracking operation, the temperature employed ranges from about 750° F. to about 1300° F., preferably from about 900° F. to about 1050° F., and the pressure employed is one ranging from about 0 psig to about 150 psig, preferably from about 1 psig to about 45 psig. Suitably, catalyst to oil ratios in the cracking zone used to convert the feed to lower boiling products are not more than about 30:1, and may range from about 20:1 to about 2:1, preferably from about 4:1 to about 9:1. The catalytic cracking process may be carried out in a fixed bed, moving bed, ebullated bed, slurry, transfer line (dispersed phase) or fluidized bed operation. Suitable regeneration temperatures include a temperature ranging from about 1100° F. (593.3° C.) to about 1500°

F. (815.5° C.), and pressure ranging from about 0 to about 150 psig. The oxidizating agent used to contact the partially deactivated (i.e., coked) catalyst will generally be an oxygen-containing gas such as air, oxygen and mixtures thereof. The partially deactivated (coked) catalyst is contacted with the oxidizing agent for a time sufficient to remove, by combustion, at least a portion of the carbonaceous deposit and thereby regenerate the catalyst in a conventional manner known in the art.

Thermal cracking is similarly practiced under conditions typical for such process, and includes visbreaking where the feed is passed through a furnace where it is heated to a temperature of about 800°–1000° F. (426.7° to 537.8° C.) and from 50 to 300 psi at the heating coil outlet. The heating coils in the furnace are arranged to provide a soaking section of the low heat density, where the charge remains until the visbreaking reactions are complete.

Coking is likewise practiced under conditions typical for such processes.

In Fluid Flexicoking, a heavy hydrocarbonaceous chargestock into a coking zone comprised of a bed of fluidized solid maintained at fluid coking conditions, including a temperature from about 850° to 1200° F., (454.4° to 649° C.) and a total pressure of up to about 150 psig, to produce a vapor phase product including normally liquid hydrocarbons, and coke, the coke depositing on the fluidized solids.

In delayed coking, the feedstock is introduced into a fractionator where it is heated and lighter fractions are removed as sidestreams. The fractionator bottoms, including a recycle stream of heavy product, are then heated in a furnace whose outlet temperature varies from about 800°–1000° F. (426.7° to 537.8° C.). The heated feedstock enters one of a pair of coking drums where the cracking reactions continue. The cracked products leave as overheads, and coke deposits form on the inner surface of the drum. To give continuous operation, two drums are used; while one is on stream, the other is being cleaned. The temperature in the coke drum ranges from about 700°–900° F. (371.1° to 482.2° C.) at pressures from about 10 to 150 psi.

The effluent from catalytic and/or thermal cracking processes or coking boiling in the 65° to 800° F. (18.3° to 426.7° C.) range is typically called distillate and/or naphtha for the sake of convenience.

The effluent from these processes, with or without intermediate fractionation is sent to the aromatics separation zone wherein separation is performed using membrane separation.

The separation of aromatics from hydrocarbon streams comprising mixtures of aromatic and non-aromatic hydrocarbons using membranes is a process well documented in the literature.

U.S. Pat. No. 3,370,102 describes a general process for separating a feed into a permeate stream and a retentate stream and utilizes a sweep liquid to remove the permeate from the face of the membrane to thereby maintain the concentration gradient driving force. The process can be used to separate a wide variety of mixtures including various petroleum fractions, naphthas, oils, hydrocarbon mixtures. Expressly recited is the separation of aromatics from kerosene.

U.S. Pat. No. 2,958,656 teaches the separation of hydrocarbons by type, i.e., aromatics, unsaturated, saturated, by permeating a portion of mixture through a non-porous cellulose ether membrane and removing permeate from the permeate side of the membrane using a sweep gas or liquid. Feeds include hydrocarbon mixtures, e.g., naphtha (including virgin naphtha, naphtha from thermal or catalytic cracking, etc.).

U.S. Pat. No. 2,930,754 teaches a method for separating hydrocarbons, e.g., aromatic and/or olefins from gasoline boiling range mixtures, by the selective permeation of the aromatic through certain non-porous cellulose ester membranes. The permeated hydrocarbons are continuously removed from the permeate zone using a sweep gas or liquid.

U.S. Pat. No. 4,115,465 teaches the use of polyurethane membranes to selectively separate aromatics from saturates via pervaporation.

Polyurea/urethane membranes and their use for the separation of aromatics from non-aromatics are the subject of U.S. Pat. No. 4,914,064. In that case the polyurea/urethane membrane is made from a polyurea/urethane polymer characterized by possessing a urea index of at least about 20% but less than 100%, an aromatic carbon content of at least about 15 mole percent, a functional group density of at least about 10 per 100 grams of polymer, and a C=O/NH ratio of less than about 8.0. The polyurea/urethane multi-block copolymer is produced by reacting dihydroxy or polyhydroxy compounds, such as polyethers or polyesters having molecular weights in the range of about 500 to 5,000 with aliphatic, alkylaromatic or aromatic diisocyanates to produce a prepolymer which is then chain extended using diamines, polyamines or amino alcohols. The membranes are used to separate aromatics from non-aromatics under perstraction or pervaporation conditions.

The use of polyurethane imide membranes for aromatics from non-aromatics separations is disclosed in U.S. Pat. No. 4,929,358. The polyurethane imide membrane is made from a polyurethane imide copolymer produced by endcapping a polyol such as a dihydroxy or polyhydroxy compound (e.g., polyether or polyester) with a di or polyisocyanate to produce a prepolymer which is then chain extended by reaction of said prepolymer with a di or polyanhydride or with a di or polycarboxylic acid to produce a polyurethane/imide. The aromatic/non-aromatic separation using said membrane is preferably conducted under perstraction or pervaporation conditions.

A polyester imide copolymer membrane and its use for the separation of aromatics from non-aromatics is the subject of U.S. Pat. No. 4,946,594. In that case the polyester imide is prepared by reacting polyester diol or polyol with a dianhydride to produce a prepolymer which is then chain extended preferably with a diisocyanate to produce the polyester imide.

U.S. Pat. No. 4,962,271 teaches the membrane separation under perstraction conditions of a distillate to produce a retentate rich in non-aromatics and alkyl-single ring aromatics and a permeate rich in multi-ring aromatics. The multi-ring aromatics recovered in the permeate are alkyl substituted and alkyl/hetero-atom substituted multi-ring aromatic hydrocarbons having less than 75 mole % aromatic carbon. The multi-ring aromatics are 2-, 3-, 4-ring and fused multi-ring aromatics.

U.S. Pat. No. 4,944,880 teaches polyester imide membranes and their use for the separation of aromatic hydrocarbons from feeds comprising mixtures of aromatic and non-aromatic hydrocarbons. The polyester imide membranes are described as being produced from a copolymer composition comprising a hard segment of polyimide and a soft segment of an oligomeric aliphatic polyester wherein the polyimide is derived from a dianhydride having between 8 and 20 carbon atoms and a diamine having between 2 and 30 carbon atoms and the oligomeric aliphatic polyester is a polyadipate, a polysuccinate, a polymalonate, a polyoxalate or a polyglutarate. The separation of aromatics from non-aromatics may be conducted under perstraction or pervaporation conditions. The hydrocarbon feed streams can be selected from heavy cat naphtha, intermediate cat naphtha, light aromatics content streams boiling in the $C_5$ - 150° C. range, light cat cycle oil boiling in the 200° to 345° C. range as well as streams in chemical plants which contain recoverable quantities of benzene, toluene, xylene or other aromatics in combination with saturates.

The process of the present invention preferably employs selective membrane separation conducted under pervaporation conditions. The feed is in either the liquid or vapor state. The process relies on vacuum or sweep gas on the permeate side to evaporate or otherwise remove the permeate from the surface of the membrane. Pervaporation process can be performed at a temperature of from about 25° to 200° C. and higher, the maximum temperature being that temperature at which the membrane is physically damaged.

The pervaporation process also generally relies on vacuum on the permeate side to evaporate the permeate from the surface of the membrane and maintain the concentration gradient driving force which drives the separation process. The maximum temperature employed in pervaporation will be that necessary to vaporize the components in the feed which one desires to selectively permeate through the membrane while still being below the temperature at which the membrane is physically damaged. While a vacuum may be pulled on the permeate side operation at atmospheric pressure on the permeate side is also possible and economically preferable. It has been discovered and is disclosed and claimed in copending application Attorney Docket Number LAW002, U.S. Ser. No. 144,859, filed Oct. 28, 1993, now abandoned in the names of Chen, Eckes and Sweet that aromatics selectivity and flux through a pervaporation membrane can be simultaneously increased by the application of pressure on the feed side of the membrane, the applied pressure being about 80 psi (551.6 kPa) and higher, preferably about 100 psi (689.5 kPa) and higher. In pervaporation it is important that the permeate evaporate from the downstream side (permeate side) of the membrane. This can be accomplished by either decreasing the permeate pressure (i.e. pulling a vacuum) if the permeate boiling point is higher than the membrane operating temperature or by increasing the membrane operating temperature above the boiling point of the permeate in which case the permeate side of the membrane can be at atmospheric pressure. This second option is possible when one uses a membrane capable of functioning at very high temperature. In some cases if the membrane operating temperature is greater than the boiling point of the permeate the permeate side pressure can be greater than 1 atmosphere. The stream containing the permeate is cooled to condense out the permeated product. Condensation temperature should be below the dew point of the permeate at a given pressure level.

The membranes can be used in any convenient form such as sheets, tubes or hollow fibers. Sheets can be used to fabricate spiral wound modules familiar to those skilled in the art.

An improved spiral wound element is disclosed in copending application U.S. Ser. No. 921,872 filed Jul. 29, 1992 now U.S. Pat. No. 5,275,726 wherein one or more layers of material are used as the feed spacer, said material having an open cross-sectional area of at least 30 to 70% and wherein at least three layers of material are used to produce the permeate spacer characterized in that the outer permeate spacer layers are support layers of a fine mesh material having an open cross-sectional area of about 10 to 50% and a coarse layer having an open cross-sectional area of about 50 to 90% is interposed between the aforesaid fine outer layers, wherein the fine layers are the layers in interface contact with the membrane layers enclosing the permeate spacer. While the permeate spacer comprises at least 3 layers, preferably 5 to 7 layers of alternating fine and coarse materials are used, fine layers always being the outer layers. In a further improvement an additional woven or non-woven chemically and thermally inert sheet may be interposed between the membrane and the multi-layer spacers, said sheet being for example a sheet of Nomex about 1 to 15 mils thick.

Alternatively, sheets can be used to fabricate a flat stack permeator comprising a multitude of membrane layers alternately separated by feed-retentate spacers and permeate spacers. The layers are glued along their edges to define separate feed-retentate zones and permeate zones. This device is described and claimed in U.S. Pat. No. 5,104,532.

Tubes can be used in the form of multi-leaf modules wherein each tube is flattened and placed in parallel with other flattened tubes. Internally each tube contains a spacer. Adjacent pairs of flattened tubes are separated by layers of spacer material. The flattened tubes with positioned spacer material is fitted into a pressure resistant housing equipped with fluid entrance and exit means. The ends of the tubes are clamped to create separate interior and exterior zones relative to the tubes in the housing. Apparatus of this type is described and claimed in U.S. Pat. No. 4,761,229.

Hollow fibers can be employed in bundled arrays potted at either end to form tube sheets and fitted into a pressure vessel thereby isolating the insides of the tubes from the outsides of the tubes. Apparatus of this type are known in the art. A modification of the standard design involves dividing the hollow fiber bundle into separate zones by use of baffles which redirect fluid flow on the tube side of the bundle and prevent fluid channelling and polarization on the tube side. This modification is disclosed and claimed in U.S. Pat. No. 5,169,530.

Preferably the direction of flow in a hollow fiber element will be counter-current rather than co-current or even transverse. Such counter-current flow can be achieved by wrapping the hollow fiber bundle in a spiral wrap of flow-impeding material. This spiral wrap extends from a central mandrel at the center of the bundle and spirals outward to the outer periphery of the bundle. As disclosed in U.S. Pat. No. 5,234,591 the spiral wrap preferably contains holes along the top and bottom ends whereby fluid entering the bundle for tube side flow at one end is partitioned by passage through the holes and forced to flow parallel to the hollow fiber down the channel created by the spiral wrap. This flow direction is counter-current to the direction of flow inside the hollow fiber. At the bottom of the channels the fluid re-emerges from the hollow fiber bundle through the holes at the opposite end of the spiral wrap and is directed out of the module.

Multiple Separation elements, be they spiral wound or hollow fiber elements can be employed either in series or in parallel. U.S. Pat. No. 5,238,563 discloses a multiple-element housing wherein the elements are grouped in parallel with a feed/retentate zone defined by a space enclosed by two tube sheets arranged at the same end of the element. The central mandrels of the elements pass through the feed/retentate zone space defined by the two tube sheets and empty permeate outside the defined space into a permeate collection zone from which it is removed, while the tube sheet directly attached to the element is in open relationship to the interior of the membrane element and retentate accumulates in the space between the top tube sheet and the bottom tube sheet from which it is removed.

Preferred membranes for use in the present invention are generally described as polyester imide membranes and are described and claimed in U.S. Pat. No. 4,944,880 and U.S. Pat. No. 4,990,275.

The polyester imide membranes are made from a copolymer comprising a polyimide segment and an oligomeric aliphatic polyester segment, the polyimide being derived from a dianhydride having between 8 and 20 carbons and a diamine having between 2 and 30 carbons and the oligomeric aliphatic polyester is a polyadipate, a polysuccinate, a polymalonate, a polyoxalate or a polyglutarate and mixtures thereof. Alternately, an activated anhydride acid such as terphthalic anhydride acid chloride may be used.

The diamines which can be used include phenylene diamine, methylene dianiline (MDA), methylene di-o-chloroaniline (MOCA), methylene bis (dichloroaniline) (tetrachloro MDA), methylene dicyclohexylamine ($H_{12}$-MDA), methylene dichlorocyclohexylamine ($H_{12}$MOCA), methylene bis (dichlorocyclohexylamine)(tetrachloro $H_{12}$MDA), 4,4'-(hexafluoroisopropylidene)-bisaniline (6F diamine), 3,3'-diaminophenyl sulfone (3,3' DAPSON), 4,4'-diaminophenyl sulfone (4,4' DAPSON), 4,4'-dimethyl-3,3'-diaminophenyl sulfone (4,4'-dimethyl-3,3' DAPSON), 2,4-diamino cumene, methyl bis(di-o-toluidine), oxydianiline (ODA), bisaniline A, bisaniline M, bisaniline P, thiodianiline, 2,2-bis[4-(4-aminophenoxy) phenyl] propane (BAPP), bis[4-(4-aminophenoxy phenyl) sulfone (BAPS), 4,4'-bis(4-aminophenoxy) biphenyl (BAPB), 1,4-bis(4-aminophenoxy) benzene (TPE-Q), and 1,3-bis(4-aminophenoxy) benzene (TPE-R).

The dianhydride is preferably an aromatic dianhydride and is most preferably selected from the group consisting of pyromellitic dianhydride, 3,3',4,4'-benzophenone tetracarboxylic dianhydride, 4,4'-(hexafluoroisopropylidene)-bis (phthalic anhydride), 4,4'-oxydiphthalic anhydride, diphenylsulfone-3,3',4,4'-tetracarboxylic dianhydride, and 3,3',4,4'-biphenyl-tetracarboxylic dianhydride.

Examples of preferred polyesters include polyethylene adipate and polyethylene succinate.

The polyesters used generally have molecular weights in the range of 500 to 4000, preferably 1000 to 2000.

In practice the membrane may be synthesized as follows. One mole of a polyester, e.g. polyadipate, polysuccinate, polyoxalate, polyglutarate or polymalonate, preferably polyethylene adipate or polyethylene succinate, is reacted with two moles of the dianhydride, e.g. pyromellitic dianhydride, to make a prepolymer in the endcapping step. One mole of this prepolymer is then reacted with one mole of diamine, e.g. methylene di-o-chloroaniline (MOCA) to make a copolymer. Finally, heating of the copolymer at 260°–300° C. for about ½ hour leads to the copolymer containing polyester and polyimide segments. The heating step converts the polyamic acid to the corresponding polyimide via imide ring closure with removal of water.

In the synthesis an aprotic solvent such as dimethylformamide (DMF) is used in the chain-extension step. DMF is a preferred solvent but other aprotic solvents are suitable and may be used. A concentrated solution of the polyamic acid/polyester copolymer in the solvent is obtained. This solution is used to cast the membrane. The solution is spread on a glass plate or a high temperature porous support backing, the layer thickness being adjusted by means of a casting knife. The membrane is first dried at room temperature to remove most of the solvent, then at 120° C. overnight. If the membrane is cast on a glass plate it is removed from the casting plate by soaking in water. If cast on a porous support backing it is left as is. Finally, heating the membrane at 300° C. for about 0.5 hours results in the formation of the polyimide. Obviously, heating to 300° C. requires that if a backing is used the backing be thermally stable, such as teflon, fiber glass, sintered metal or ceramic or high temperature polymer backing.

EXAMPLE 1

A laboratory membrane separation run was made on a sample of light cat cycle oil secured from a refinery source. The sample boiled between 306°–519° F. (about 152.2° to 271.5° C.). The membrane separation run was conducted at 140° C./10 mm Hg permeate pressure using polyesterimide membrane as the aromatics permselective membrane.

The polyester-imide (PEI) membrane was prepared as follows:

One point zero nine (1.09) grams (0.005 moles) of pulverized pyromellitic dianhydride (PMDA) was placed into a reactor. Five (5.0) grams (0.0025 moles) of predried 2000 MW polyethylene adipate (PEA) was added to the reactor. The PEA was dried at 60° C., and a vacuum of approximately 20" Hg. The prepolymer mixture as heated to 140° C. and stirred vigorously for approximately 1 hour to complete the endcapping of PEA with PMDA. The viscosity of the prepolymer increased during the endcapping reaction ultimately reaching the consistency of molasses.

The prepolymer temperature was reduced to 70° C. and then diluted with 40 grams of dimethylformamide (DMF). Zero point six seven (0.67) grams (0.0025 moles of 4,4'-methylene bis(o-chloroaniline)(MOCA) was added to 5.2 grams of DMF. The solution viscosity increased as the chain extension progressed. The solution was stirred and the viscosity was allowed to build up until the vortex created by the stirrer was reduced to approximately 50% of its original height. DMR was added incrementally to maintain the vortex level until 73.2 grams of DMF had been added. Thirty minutes was taken to complete the solvent addition. The solution was stirred at 70° C. for 2 hours then cooled to room temperature.

The polymer solution prepared above was cast on 0.2u pore teflon and allowed to dry overnight in $N_2$ at room temperature. The membrane was further dried at 120° C. for approximately another 18 hours. The membrane was then placed into a curing oven. The oven was heated to 260° C. for 5 minutes and finally allowed to cool down close to room temperature (approximately 4 hours).

Aromatics/Non-Aromatics Seperation of Cracked Stocks by Pervaporation

| Stream | Feed | Permeate | Retentate |
|---|---|---|---|
| Yield, wt. % | — | 53 | 47 |
| Composition: | | | |
| Aromatics, wt. % | 70.1 | 88.8 | 49.1 |
| Sulfur, wppm | 1.3 | 1.8 | 0.8 |
| Nitrogen, wppm | 164 | 261 | 55 |

-continued

| Aromatics/Non-Aromatics Seperation of Cracked Stocks by Pervaporation | | | |
|---|---|---|---|
| Stream | Feed | Permeate | Retentate |
| Membrane Performance | | | |
| Aromatics/Non-Aromatics | | 5.4 | |
| Sulfur/Non-Aromatics | | 6.4 | |
| Nitrogen/Non-Aromatics | | 8.6 | |
| Flux, $Kg/m^2 \cdot day$ | | 244 | |

As can be seen from the table, the permeate is nearly 90 wt % aromatic resulting, at typical commercial yield of 47% in a saturates rich retentate stream containing only about 50% aromatics. It is this retentate stream which would be recycled to the fluid cat cracker. The permeate stream could be blended to product or sent to a Hydrocracker. It can be calculated that an aromatics/non-aromatics selectivity of 5.4, defined as the ratio of aromatics to non-aromatics in the permeate versus the average of the feed and the retentate was achieved. Similarly, it was found that PEI membrane has excellent nitrogen and sulfur selectivity, at 8.6 and 6.4. In the case where permeate is sent to a hydrocracker this would place these undesirable sulfur, nitrogen components in a process better able than the fluid cat cracker to remove them from the finished products. The flux obtained with PEI membrane was excellent, at 244 $Kg/m^2$.day.

What is claimed is:

1. A method for producing gasoline and light olefins from a liquid hydrocarbonaceous feed stream boiling in the range 65° F. (18.3° C.) to above 1050° F. (565.5° C.) which comprises subjecting the liquid hydrocarbonaceous feed to a non-hydrogen consuming process step selected from thermal or catalytic cracking, recovering the 65° to 800° F. (18.3° to 426.7° C.) effluent from said non-hydrogen consuming process step, passing said effluent or a fraction thereof to a membrane aromatic separation zone containing a polyester imide membrane therein producing an aromatics and nitrogen rich fraction and a non-aromatics rich fraction, passing the non-aromatics rich fraction back to the non-hydrogen consuming process step wherein the non-aromatic rich fraction stream is combined with liquid hydrocarbonaceous feed stream and is therein converted to light products resulting in increased yield of gasoline and light olefins.

2. A method for producing gasoline and light olefins from a liquid hydrocarbonaceous feed stream boiling in the range 65° F. (18.3° C.) to above 1050° F. (565.5° C.) which comprises subjecting the liquid hydrocarbonaceous feed to a non-hydrogen consuming process step selected from fluid flexicoking or delayed coking, recovering the 65° to 800° F. (18.3° to 426.7° C.) effluent from said non-hydrogen consuming process step, passing said effluent or a fraction thereof to a membrane aromatic separation zone containing a polyester imide membrane therein producing an aromatics and nitrogen rich fraction and a non-aromatics rich fraction, passing the non-aromatics rich fraction back to the non-hydrogen consuming process step wherein the non-aromatic rich fraction stream is combined with liquid hydrocarbonaceous feed stream and is therein converted to light products resulting in increased yield of gasoline and light olefins.

3. The method of claim 1 or 2 wherein the effluent from the non-hydrogen consuming process step boiling in the range 65° to 800° F. (18.3° to 426.7° C.) is fractionated to recover a distillate fraction boiling in the 300° to 800° F. (148.9°–426.7° C.) range which distillate boiling range fraction is passed to the membrane separation zone.

4. The method of claim 1 or 2 wherein the effluent from the non hydrogen consuming process step boiling in the 65° to 800° F. (18.3° to 426.7° C.) range is fractioned to recover a naphtha fraction boiling in the 65° to 430° F. (18.3° to 221.1° C.) range which naphtha boiling range fraction is passed to the membrane separation zone.

5. The method of claim 1 or 2 wherein the membrane separation zone operates under pervaporation conditions.

6. The method of claim 1 wherein the polyester imide membrane is made from a copolymer comprising a polyimide segment and an oligomeric aliphatic polyester segment wherein the polyimide is derived from a dianhydride or activated anhydride acid having between 8 and 20 carbons and a diamine having between 2 and 30 carbons and the oligomeric aliphatic polyester is a polyadipate, a polysuccinate, a polymalonate, a polyoxalate, a polyglutarate, or mixtures thereof.

* * * * *